US008646666B2

(12) United States Patent
May

(10) Patent No.: US 8,646,666 B2
(45) Date of Patent: Feb. 11, 2014

(54) CARRIER WITH ADJUSTABLE PARALLEL TRACK STRUCTURE FOR RETAINING MUSICAL INSTRUMENTS

(75) Inventor: Randall L. May, Newport Beach, CA (US)

(73) Assignee: Randall May International, Incorporated, Irving, CA (US)

( * ) Notice: Subject to any disclaimer, the term of this patent is extended or adjusted under 35 U.S.C. 154(b) by 961 days.

(21) Appl. No.: 11/893,871

(22) Filed: Aug. 18, 2007

(65) Prior Publication Data

US 2009/0045235 A1 Feb. 19, 2009

Related U.S. Application Data

(63) Continuation-in-part of application No. 11/021,596, filed on Dec. 23, 2004, now Pat. No. 7,326,842.

(51) Int. Cl.
*A45F 3/10* (2006.01)

(52) U.S. Cl.
USPC ..... 224/265; 84/421; 84/327; 224/910; 224/201

(58) Field of Classification Search
USPC ..... 224/910, 265, 266, 201, 268, 197; 84/421, 327; 248/443, 444
See application file for complete search history.

(56) References Cited

U.S. PATENT DOCUMENTS

| | | | | |
|---|---|---|---|---|
| 3,405,587 | A | 10/1968 | Meazzi et al. | |
| 4,256,007 | A | 3/1981 | Streit | |
| 4,387,839 | A | 6/1983 | Dranchak | |
| 4,402,441 | A * | 9/1983 | Jones et al. | 224/265 |
| 4,450,993 | A * | 5/1984 | Ephraim | 224/265 |
| 4,605,144 | A | 8/1986 | LaFlame | |
| 4,634,032 | A * | 1/1987 | LaFlame | 224/265 |
| 4,715,293 | A * | 12/1987 | Cobbs | 108/43 |
| 4,799,610 | A * | 1/1989 | Hsieh | 224/266 |
| 5,054,357 | A | 10/1991 | Pyle | |
| 5,076,131 | A * | 12/1991 | Patterson | 84/421 |
| 5,337,646 | A | 8/1994 | Austin | |
| D354,975 | S | 1/1995 | Penn | |
| 5,421,499 | A * | 6/1995 | Bauer | 224/270 |
| 5,573,158 | A | 11/1996 | Penn | |
| 5,949,008 | A | 9/1999 | Augsburger | |
| 6,028,257 | A | 2/2000 | May | |
| 6,096,955 | A | 8/2000 | Ter | |
| 6,323,407 | B1 | 11/2001 | May | |
| 6,329,583 | B1 * | 12/2001 | May | 84/421 |
| 6,881,886 | B2 | 4/2005 | May | |
| 7,071,401 | B2 | 7/2006 | May | |

(Continued)

*Primary Examiner* — Justin Larson
*Assistant Examiner* — Peter Helvey
(74) *Attorney, Agent, or Firm* — Kirk A. Buhler; Buhler & Associates

(57) ABSTRACT

An instrument carrier is disclosed for supporting one or more drums without using traditional "J" rods components. The carrier uses sliders that eliminate the interference with the user's legs and more particularly the user's thighs and provides a more natural stride of the user. The drum mounting structure is repositioned or translated on the sliders. The carrier allows the drum to be rigidly mounted in a variety of positions relative to the user. The cantilevered weight of the drum(s) rotates the drum or drum array to lock the drum(s) into a vertical or horizontal slots or saddle. In another embodiment a bridge extends from the carrier to a single post or tube to support a slidably mounted single drum. The structure also eliminates the necessity of a structurally rigid fixed abdomen plate and allows for use of a flexible and conforming abdomen plate.

20 Claims, 7 Drawing Sheets

(56) References Cited

U.S. PATENT DOCUMENTS

| | | | | |
|---|---|---|---|---|
| 7,166,790 | B2 | 1/2007 | May | |
| 7,276,653 | B2 * | 10/2007 | Shimada | 84/421 |
| 7,326,842 | B2 * | 2/2008 | May | 84/421 |
| 7,394,008 | B2 * | 7/2008 | May | 84/421 |
| 7,420,110 | B2 * | 9/2008 | May | 84/421 |
| 7,544,875 | B2 * | 6/2009 | Hsieh | 84/421 |
| 7,554,024 | B2 * | 6/2009 | Miyajima | 84/421 |
| 7,576,276 | B2 * | 8/2009 | Hallerberg | 84/421 |
| 7,591,401 | B2 * | 9/2009 | Sandler | 224/201 |
| 7,621,066 | B1 * | 11/2009 | Mathison | 43/21.2 |
| 2001/0047716 | A1 * | 12/2001 | May | 84/421 |
| 2002/0125278 | A1 * | 9/2002 | Wagmild | 224/268 |
| 2003/0217636 | A1 * | 11/2003 | May | 84/421 |
| 2004/0194608 | A1 | 10/2004 | May | |
| 2005/0040193 | A1 * | 2/2005 | May | 224/201 |
| 2005/0103183 | A1 * | 5/2005 | May | 84/411 R |
| 2005/0183565 | A1 * | 8/2005 | May | 84/421 |
| 2006/0081115 | A1 * | 4/2006 | Shimada | 84/421 |
| 2006/0096443 | A1 * | 5/2006 | May | 84/421 |
| 2006/0137506 | A1 * | 6/2006 | May | 84/327 |

* cited by examiner

CARRIER WITH ADJUSTABLE PARALLEL TRACK STRUCTURE FOR RETAINING MUSICAL INSTRUMENTS

CROSS REFERENCE TO RELATED APPLICATION

This application is a continuation-in-part of applicant's application Ser. No. 11/021,596 filed Dec. 23, 2004, now U.S. Pat. No. 7,326,842 that issued on Feb. 5, 2008 the entire contents of which is hereby expressly incorporated by reference herein.

FIELD OF THE INVENTION

This invention relates to a shoulder mounted percussion instrument carrier for one or an array of drums of various sizes. More particularly, the present invention relates to a carrier for one or more drums and replaces traditional "J" rods components. The elimination of the "J" rod components eliminates the interference with the user's legs and more particularly the user's thighs and provides a more natural stride of the user. Since the vertical or horizontal slots or saddle are not holes, that are commonly found with "J" rod carriers, the drum mounting structure can be repositioned or translated within the vertical or horizontal slots. The carrier allows the drum to be rigidly mounted in a variety of positions relative to the user. The mounting consists of a plurality of sliding connections that move independently from any adjustments from the carrier. The cantilevered weight of the drum(s) locks the drums into a vertical or horizontal slots or saddle. The structure also eliminates the necessity of a structurally rigid fixed abdomen plate and allows for use of a flexible and conforming abdomen plate.

BACKGROUND OF THE INVENTION

The prior art discloses examples of carriers using "J"-rods on an instrument carrier to support one or an array of drums. A number of drum holding apparatus have been patented and used, but none provide the combination of features disclosed and claimed herein.

La Flame U.S. Pat. No. 5,400,683 discloses a carrier for percussion instruments having an abdominal plate connected at one end of a unitary frame partly encircling the wearer at the waist and having an upstanding rear portion pivotally connected to a back pressure plate. Shoulder bars are connected to the back-pressure plate and wrap about shoulders and support straps connect to the abdominal plate.

Hsieh U.S. Pat. No. 4,799,610 shows a carrier for percussion instruments having a "T" bar, a pair of shoulder bars, and a belly plate. The shoulder bars are bolted on a lateral plate of the "T" bar. The lateral plate has arc-like slots and spaced semi-circular holes permit bolts to slide in the slots. The fastening end of each shoulder bar has a hole and an arc-like slot from the upper portion to the lower portion permitting angular adjustment of the shoulder rightward or leftward for various applications.

La Flame U.S. Pat. No. 4,643,032 shows a carrier for various instruments such as marching bells, a marching xylophone or a marching marimba, which are supported on the apparatus by the use of suitably-constructed extension arms. The carrier frame is a U-shaped bent bar welded or otherwise attached to a belly plate and has extension arms, which project from the belly plate to engage and support the instrument.

La Flame GB patent 2,123,676 (based on U.S. Pat. No. 4,453,442) discloses a carrier for percussion instruments or the like which includes the combination of a belly plate with a carrier bracket for supporting an instrument at an outwardly-overhung position about a fulcrum area of contact with the front waistline area of the person, a rigid band with a generally bent contour to extend along a portion of the waistline area of the person to the back of the person, a back-plate riser arm supported by the ban to extend in a generally upward direction such that a portion of the arm will extend along the back thoracic region of the person, and means carried by the arm for imparting to the thoracic back region of the person a reactive force to the overhung weight of the instrument about the aforesaid means forming a fulcrum area of contact with the person.

Various patents from the applicant May have been issued covering carriers with "J" rods or similar attachment mechanisms for securing musical instruments, patents with this type of mechanism are found in U.S. Pat. Nos. 5,691,492, 6,028,257, 6,323,407, 6,329,583, 6,172,290, 6,403,869, 6,770,805, 6,881,886, 7,071,401, and published applications US2005/0040,193, US2006/0096,443, US2005/0103,183 and US2005/0183,565, but none of these disclose the carrier structure disclosed within this application.

Various prior inventions have been disclosed that attempt to provide mounting for one or a plurality of drums. Most of these products have the drum(s) fixed to the carrier or use "J" rods to secure the drum(s) to the carrier. These carriers have limitations that require an abdominal plate that is an integral part of the carrier. Because of the mechanical structure of these carriers they restrict or alter natural walking or rapid stride movement of the user. The proposed carrier provides improvements that eliminate the aforementioned limitations.

BRIEF SUMMARY OF THE INVENTION

It is an object of the shoulder mounted apparatus is to provide a carrier that allows a user to carry and play one or more drums while they transport the drum such as when they are walking, marching or rapidly moving. The mounting allows for the drum(s) to be maintained in a horizontal or rotated vertical orientation where the drumheads are oriented in a horizontal configuration allowing the drum to be played by striking the drumhead(s).

It is another object of the drum mounting apparatus, when it is configured with a single sliding (mono) post, to provide a simplified mounting apparatus that allows height of the horizontal playing surface of the drum to be raised and lowered by sliding the drum mounting apparatus on the single (mono) post. The mounting apparatus on the carrier has a vertical slot and the mounting apparatus on the drum has a horizontal pin or rod that slides into the vertical slot to secure the drum on the carrier. The drum is quickly removed from the carrier by lifting the pin or rod out of the slot.

It is another object of the drum mounting apparatus, when it is configured as with two or more posts to provide a stable box structure for the drum(s) to be supported on the carrier. The box structure refers to the two sets of slides or tracks that are mounted to the carrier and a corresponding two sets of slides are mounted on hardware having vertically or horizontally oriented slots or saddle. An array of drums is mounted to a tenor rail that engages onto the vertically or horizontally oriented slots or saddle to support the drums on the carrier. The overhung cantilevered weight of the drums secures the drum array in the vertically or horizontally oriented slots or saddle. The ability to integrate the slides onto the carrier allows the drums to be more rigidly secured to the carrier and significantly reduces flexing of the drum or drum array with the carrier to improve the stability of the playing surface when the user is moving or playing the drums. When the drums are brought closer to the user the overhung distance is decreased and the cantilevered load is decreased and reduces the strain on the back of the user. Since the tenor rail rests in the vertically or horizontally oriented slots or saddle the tenor rail can be slid horizontally in the carrier to justify the drums left or right of the center of the user. A user can place one or more marks on the tenor rail to identify specific balancing or positioning locations for the drum array when drums of different sizes and weights are placed in the drum array.

It is another object of the drum mounting apparatus to allow the drum or drum array to be easily installed and removed from the carrier to allow the drum or drum array to be placed in a floor mounted stand.

Another object of the drum mounting apparatus to provide connection for an abdomen plate that can float or be removed from the carrier. This allows the abdomen plate to move with the user. Since the majority of the load from the drum(s) is from gravity the vertical load on the abdomen plate is essentially zero and the abdomen plate can be removed, secured on a pivoting mechanism with temporary securing means that does not penetrate the abdomen plate such as hook and loop fasteners.

It is still another object of the carrier to provide a carrier where structure eliminates the necessity of a structurally rigid fixed abdomen plate and allows for use of a flexible and conforming abdomen plate.

It is still another object of the carrier to integrate the two sets of dovetailed sliders is a parallel arrangement to allow the drums to be easily raised and lower on the carrier in a linear sliding arrangement.

Various objects, features, aspects, and advantages of the present invention will become more apparent from the following detailed description of preferred embodiments of the invention, along with the accompanying drawings in which like numerals represent like components.

DRAWINGS—REFERENCE NUMERALS

| | |
|---|---|
| 10 | Carrier |
| 11 | Drum |
| 12 | Rotation hinge plate |
| 14 | Knuckle |
| 15 | Hinge pin |
| 17 | Bolts |
| 18 | Nuts |
| 19 | Tension rods |
| 20 | Washers |
| 22 | Pivot |
| 24 | Ear |
| 30 | Abdomen plate |
| 32 | Support rods or tubes |
| 34 | Support rods or tubes |
| 36 | Parallel portion |
| 38 | Parallel portion |
| 41 | Dovetail grooves |
| 42 | Support rods of tubes |
| 44 | Support rods or tubes |
| 45 | Out turned portions |
| 46 | Out turned portions |
| 50 | Shoulder strap |
| 51 | Cushions |
| 53 | Cushions |
| 54 | Cushions |
| 55 | Shoulder strap |
| 56 | Supporting member |
| 60 | Spacer |
| 61 | Flat plate portion |
| 62 | Half tube saddle portion |
| 63 | Slide bracket |
| 64 | Fasteners |
| 65 | End portion |
| 66 | Dovetail rib |
| 70 | Back bar |
| 72 | Bumper |
| 74 | Rotational movement |
| 78 | Tightening hardware |
| 79 | Tightening hardware |
| 80 | Clamping receptacle |
| 81 | Clamping receptacle |
| 82 | Tightening hardware |
| 83 | Tightening hardware |
| 84 | Sliding cradle |
| 85 | Male dovetail |
| 86 | Slides |
| 87 | Cradle |
| 88 | Plate |
| 89 | Drum rotators |
| 90 | Bridge support member |
| 91 | Thumbscrew |
| 92 | Clamp |
| 93 | Slot |
| 94 | Clamp |
| 95 | Access hole |
| 96 | Slide |
| 97 | Securing bolt |
| 98 | Bolts |
| 99 | Bolts |
| 260 | Tubes or Shafts |
| 300 | Retainer |
| 310 | First bifurcated structure |
| 311 | Left half of first bifurcated structure |
| 312 | Right half of first bifurcated structure |
| 320 | Mounting clamps |
| 331 | Set screw |
| 332 | Set screw |
| 340 | Linear tracks |
| 341 | Linear tracks |
| 350 | Second bifurcated structure |
| 353 | Lower radius or saddle |
| 354 | Upper radius |

-continued

| | |
|---|---|
| 401 | Lowered |
| 402 | Positionable |
| 403 | Positionable |
| 405 | Drum array side member |
| 410 | Drum array |
| 420 | Drum array tube |
| 421 | Lower tube |
| 422 | Upper tube |

DETAILED DESCRIPTION

Figure 1:
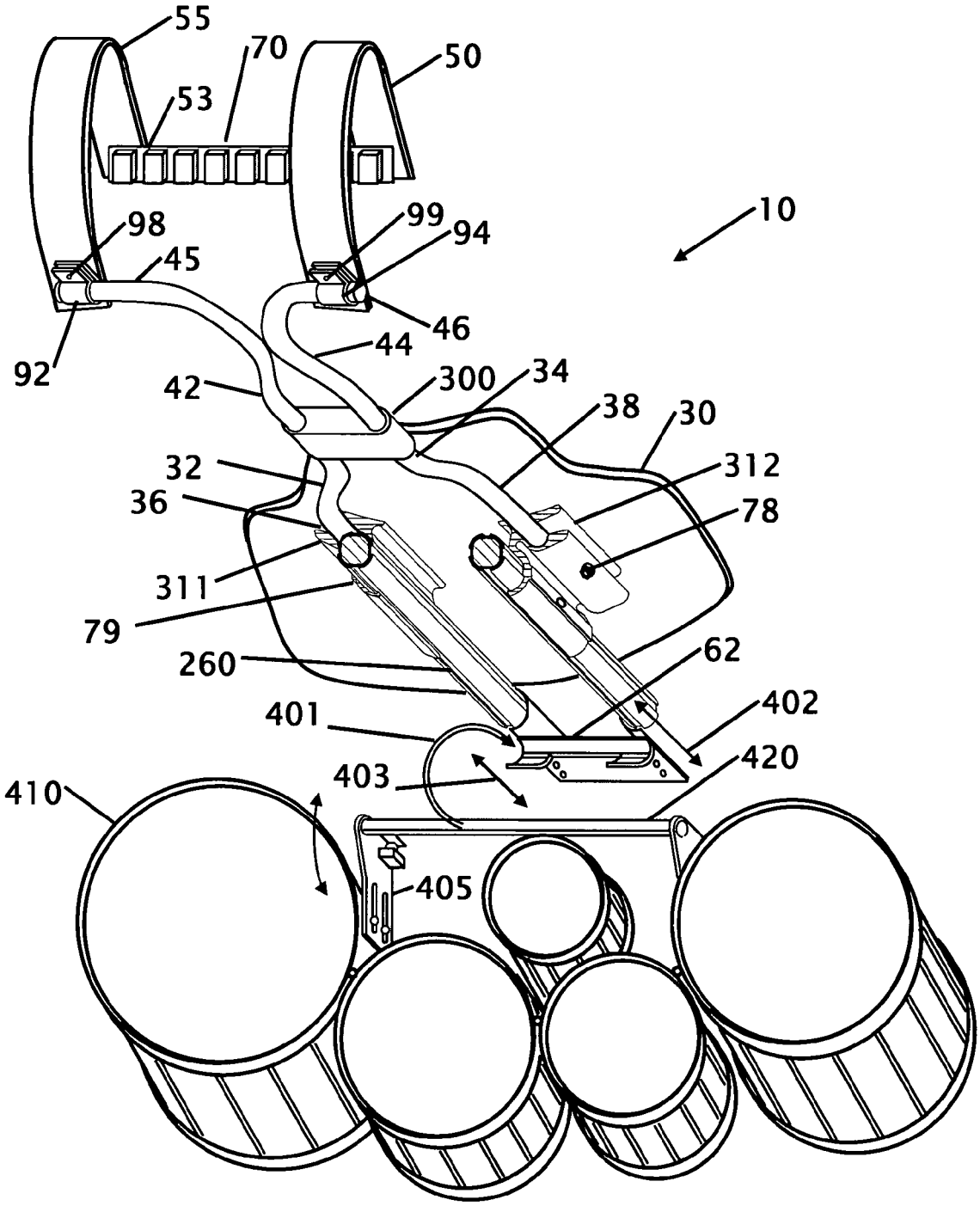
FIG. 1 shows an instrument carrier according to a first preferred embodiment.

Referring to FIG. 1 shows an instrument carrier according to a first preferred embodiment. This figure shows a Tubular type carrier 10 for percussion instruments that comprises an abdomen plate 30, with lower support tubes or rods 32 and 34. The figure also has upper body vertical support rods or tubes 42 and 44 that are supported mid-span with a retainer 300. In the figure shown the coupler is a fixed member that holds the tubes in rigid position, but it is also contemplated that the coupler could be a hinge or an adjustable coupler that allows the distance between the upper and lower portions of the carrier to be adjusted as well as a single or compound hinged coupler that allows the carrier to be folded as shown in May U.S. Pat. No. 7,166,790 and May U.S. Pat. No. 6,323,407.

The lower rods or tubes 32 and 34 are bent where they independently spread to parallel portions 36 and 38 where they attach to supporting abdomen plate 30. Upper rods or tubes 42 and 44 having out-turned portions 45 and 46 supporting rigid shoulder straps 50 and 55 and back bar 70. Back bar 70 may be removably secured to shoulder straps 50 and 55 or may be fixed as by welding or the like. Shoulder straps 50, 55, and back bar 70 have cushions 53. The cushions are of a type used to pad the interior of football and other sports helmets and are shown in more detail in co-issued May U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded. The abdomen plate 30 is removably secured on the lower ends of tubes or rods 32 and 34 by the left and right halves of the first bifurcated structure 311 and 312 respectively where each half uses semi-circular clamping receptacle that tubes 36 and 38 fit through. In the embodiment shown the first bifurcated structure is shown and described in two halves it is contemplated that these two halves can be fabricated as a single (attached) unit. Tightening hardware 78 and 79 (not visible) clamps the tube or rod to secure them within the left and right halves of the first bifurcated structure 311 and 312 prevent movement. The two halves of the first bifurcated structure 311 and 312 are secured on abdomen plate 30. The clamping receptacles are shown mounted to the abdomen plate 30, and the tubes can be re-positioned within the clamping receptacle, but the clamping receptacles (part of first bifurcated structure 311 and 312) can be mounted into slots or without fasteners that penetrate the abdomen plate, such as hook and loop, that allow the locations of the clamping receptacles to be free floating on the abdomen plate. The upper, out-turned ends 45 and 46 of supporting rods or tubes are supported in clamping receptacles 92 and 94 on shoulder straps 50 and 55. Clamps 92 and 94 hold rods or tubes 45 and 46 on the shoulder supports. Clamping mechanisms 92 and 94 consist of a semi-circular receptacle that tubes 45 and 46 fit through. The bolts 98 and 99 are tightening to clamp the tube or rod to secure them within the receptacle and prevent movement as shown in May U.S. Pat. No. 7,071,401.

The materials of construction used in this carrier 10 are very important for achieving the desired result. The abdomen plate 30 is preferably made from a flexible material to aid in contouring to the players profile and size. The supporting rods or tubes 32, 34, 42, and 44, shoulder straps 50, 55 and back bar 70 are rigid and made of a light metal such as aluminum, magnesium or titanium. The metal shoulder straps have the advantage that different sizes of users are readily accommodated by adjusting or replacing the shoulder straps in a vertical or horizontal plane.

Operation

The operation of this carrier should be apparent but will be described briefly for clarity. The carrier 10 is worn by a musician with the shoulder straps 50 and 55 positioned over the shoulders. The position of the shoulder straps and the upper portion of the carrier can be adjusted by loosening bolts 78 and 79 for vertical adjustment of the shoulders. When the bolts 98 and 99 are loosened, clamps 92 and 94 open to allow tubes 42 and 44 to slide within the clamps. When the clamps are loose, the position of the clamps on the shoulder straps can also be adjusted. The vertical adjustment of the shoulder straps allows users of different sizes to use the carrier. The width between the shoulder straps can also be adjusted by rotating the tubes 42 and 44 within retainer 300. When tubes 42 and 44 are rotated the width of the shoulder straps are moved in and out. The rotational adjustment allows the tubes to be toe-in so the width and or the position of the tubes can be adjusted. The toe-in adjustment is mostly used with tubular construction, but a similar adjustment could be made with other types of carrier construction. The abdomen plate 30 is attached to the left and right halves of the first bifurcated structure 311 and 312 and then to rods 36 and 38 that are inserted in position and secured in place by tightening bolts 78 and 79. The parallel ends of the rods 36 and 38 are inserted into the receptacles on the abdomen plate. When bolts 78 and 79 are loosened, receptacles move on tubes 36 and 38 can be moved to allow positioning of the abdomen plate on the carrier. This adjustment allows the carrier to accommodate user of various sizes. The left and right bifurcated structure 311 and 312 have an additional attachment mechanism for the percussion instrument being carried e.g., drums (single or array), cymbals, xylophone, marimba, or the like that will be further described herein.

The tubular carrier shown includes an abdomen plate 30 that is secured or can float on the structure without being rigidly secured to the halves of the first bifurcated structure 311 and 312. The support rods or tubes 34 and 36 of the carrier bend and extend into their respective halves of the first bifurcated structure 311 and 312 where they are positionable and lockable in position. The tubes 260 slide in their respective halves of the first bifurcated structure 311 and 312 to allow for positioning 402 of the drum array 410 and drum hardware 420 independently from the positioning of the distance between the shoulder supports 50, 55 and the abdomen plate 30. In operation the drum array tube 420 from the drum array is lowered 401 into the essentially horizontal saddle 403 until the tube 420 from the drum array rests on the bottom radius of the half tube saddle portion 62. The cantilevered weight of the drum array will rotate the drum array binding the dovetail rib 66 (FIG. 2) of the half tube portion 62 with one end portion 65 to fit one of the dove tailed grooves 41 and a dove tailed rib 66 fitting into an adjacent groove. The drum array tube 420 can side horizontally along the half tube portion 62 where the drum array is justified left or right of the player.

Drum array tube 420 is lowered 401 into the half tube saddle portion 62 where it is retained. The retention is shown and described in more detail with FIGS. 2-4. The slide bracket 63 connects with a set of parallel tracks that mate with the tubes or shafts 260 to allow the half tube saddle portion 62 to secure the drum array, and can be raised or lowered 402 on the tubes or shafts 260. Drum array side member(s) 405 connect the tube 420 to the drum array 410. The drum array tube 420 can side horizontally in the half tube portion 62 such that the drum array is justified drum array tube 420 is marked to identify the balance position or other indicia to identify a particular location. Another contemplated feature is to include one or more stops on the drum array tube 420 to limit side (slide) movement of the drum array in the half tube saddle portion 62.

Figure 2:
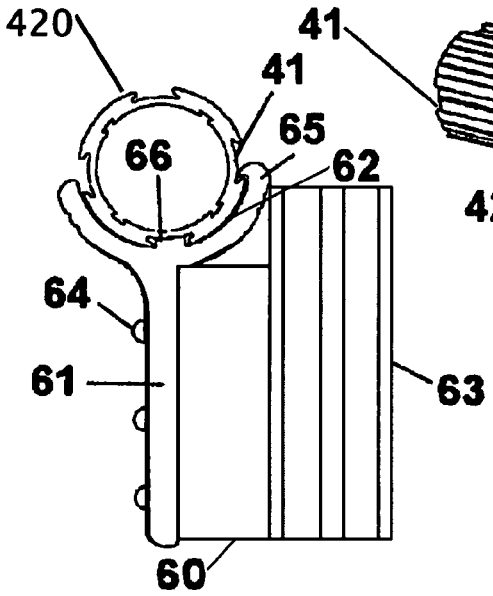
FIG. 2 shows a drum array tube engaged in the half tube portion from in the first embodiment.

FIG. 2 shows the drum array tube 420 engaged in the half tube saddle portion 62 from in the first embodiment. One of the slide brackets 63 is shown. The slide bracket slides on the tubes or shafts 260 (not shown) in a bypass arrangement that allows the slide bracket to bypass the connection of the tubes or shafts 260 with the first bifurcated structure (not shown). Spacer 60 keeps the end portion 65 properly spaced from the slide bracket 63 to prevent interference of the end portion 65 and the left or right side of the first bifurcated structure 311, 312 or the carrier. The spacer 60 is secured to the flat plate portion 61 of the end portion 65 with hardware 64 such as screws or bolts but other securing hardware or welding is contemplated. The drum array tube 420 is shown locked in the half tube saddle portion 62 with the dovetail rid 66 engaged with dovetail grooves 41.

Figure 3:
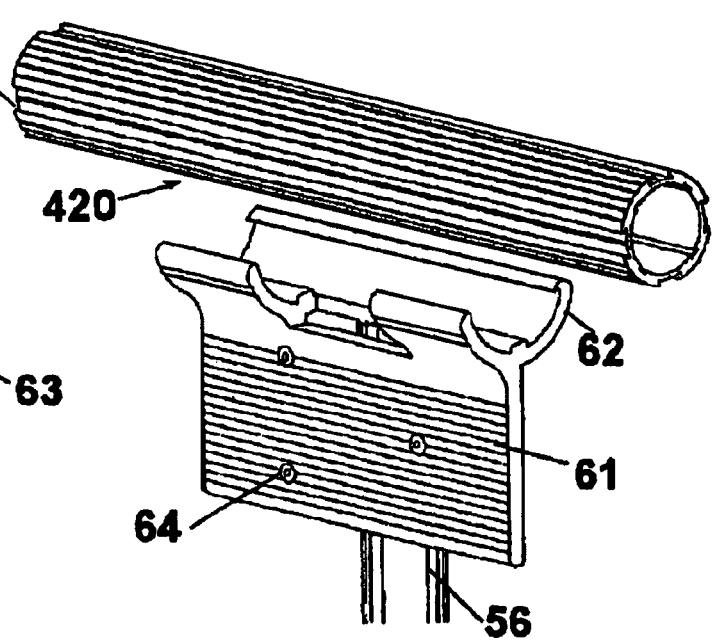
FIG. 3 shows the components from FIGS. 1 and 2 as it is mounted on a floor mounted stand.

FIG. 3 shows the components from FIGS. 1 and 2 as it is mounted on a floor mounted stand. The floor mount stand comprises a supporting member 56 having the flat plate portion 61 and a half tube saddle portion 62. The half tube saddle portion 62 is mounted on the upper end of vertical tube 56 with hardware 64, which secures on the flat plate portion 61 of the half tube saddle portion 62. Half tube saddle portion 62 has dove tailed grooves 41 that mates and secures with onto a dove tailed rib 66 fitting into an adjacent groove (as shown in FIG. 2).

Figure 4:
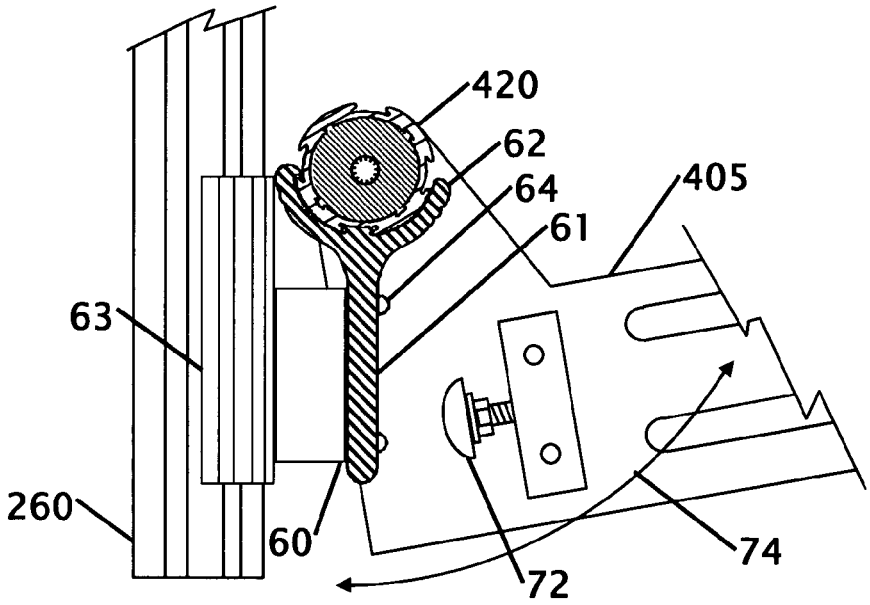
FIG. 4 is a detail view of the rotation of the drum array and the stop that prevents over rotation and adjustment of the drum array angle.

FIG. 4 is a detail view of the rotation of the drum array and the stop that prevents over rotation and adjusts the playing angle of the drum array. In this figure an array of drums is engaged in the carrier. The slide bracket 63 is shown sliding on a tube or shaft 260 on the carrier. A spacer 60 maintains the position of the half tube saddle portion 62 from the tubes or shaft 260. The spacer is secured by fasteners 64 that connected from the flat plate portion of the half tube saddle portion 62 through the spacer 60 and then into the slide bracket 63. The drum array tube 420 is secured in the half tube saddle portion 62 where the male and female dovetail grooves hold the upper tube in location. The drum array side member 405 is shown rotated 74 from horizontal to show the bumper 72 displaced from contact with the flat portion 61. The array of drums can be rotated up or down and the downward, horizontal, resting position of the array is adjustable by moving the bumper 72. The slide bracket 63 is movable, and securable on the tubes or shafts 260 to allow the height adjustment of the instrument. The height adjustment in this embodiment is independent from the adjustment for the abdomen plate 30 in FIG. 1.

Figure 5:
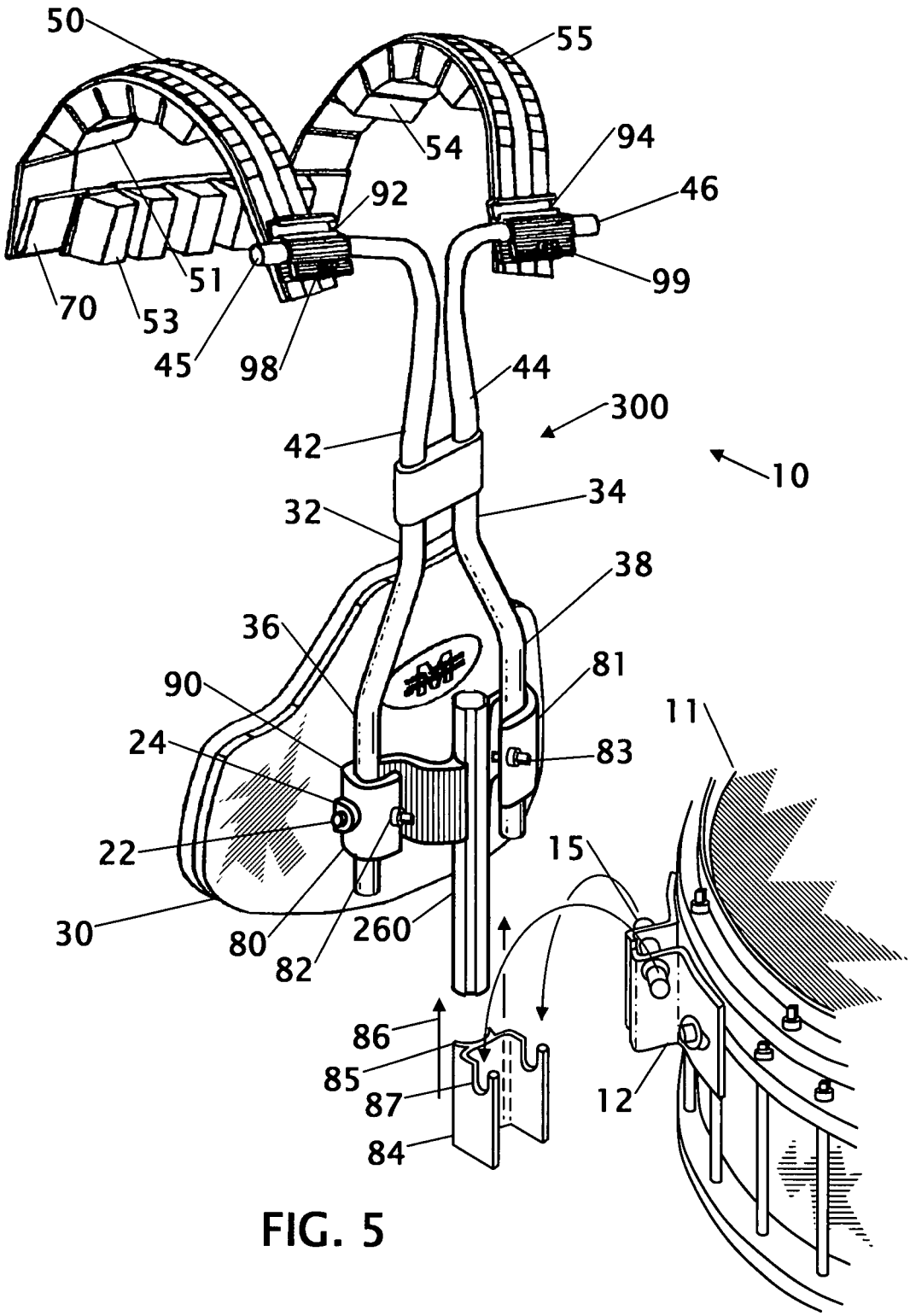
FIG. 5 shows a view of the drum tracking system for use with a single drum.

FIG. 5 shows a view of the drum tracking system for use with a single drum 11. This figure shows a Tubular type carrier 10 that is similar in construction to the carrier for percussion instruments shown and described in FIG. 1. The carrier 10 comprises an abdomen plate 30, with lower support rods 32 and 34. The figure also has upper body vertical support rods or tubes 42 and 44. The upper and lower body support rods or tubes are connected to each other with a retainer 300 that keeps the tubes in a parallel relationship. The lower rods or tubes 32 and 34 independently spread to parallel portions 36 and 38 where they attach to supporting abdomen plate 30. Upper rods or tubes 42 and 44 having out-turned portions 45 and 46 supporting rigid shoulder straps 50 and 55 and back bar 70. Back bar 70 may be removably secured to shoulder straps 50 and 55 or may be fixed as by welding or the like. Shoulder straps 50, 55, and back bar 70 have cushions 51, 53 and 54, respectively. The cushions are of a type used to pad the interior of football and other sports helmets and are shown in more detail in co-issued May U.S. Pat. No. 6,028,257. The cushions have a backing strip of polyvinyl plastic film. A thin sheet of polyvinyl film encloses blocks of closed pore plastic (e.g., polystyrene or polyurethane) foam and is sealed to the backing strip to enclose separate blocks which are separately compressible and provide more comfort to the wearer of the carrier when fully loaded.

The abdomen plate 30 is secured to the bridge supports 90 with a pivot 22 that extends through ears 24 on the abdomen plate 30. The placement of the pivot through the center of the bridge support 90 allows the abdomen plate to rotate a limited amount on the pivot(s) 22. The pivoting allows the abdomen plate to move with the user without significantly altering the position of the carrier on the user. The pivots can be tightened slightly to provide frictional or limited pivoting as well as loosened to allow for free pivoting. It is also contemplated that the abdomen plate 30 is removably secured on carrier.

Clamping receptacle(s) 80 and 81 consist of a semi-circular receptacle that tubes 36 and 38 fit through. Tightening hardware 82 and 83 clamps the tube or rod to secure them within the receptacle and prevent movement. The clamping receptacle(s) 80 and 81 are secured on abdomen plate 30. The receptacles are shown mounted to the abdomen plate 30, and the tubes can be re-positioned within the receptacle, but the receptacles can be mounted to slots that allow the locations of the receptacles to be moved. The upper, out-turned ends 45 and 46 of supporting rods or tubes are supported in clamping receptacles 92 and 94 on shoulder straps 50 and 55. Clamps 92 and 94 hold rods or tubes 45 and 46 on the shoulder supports. Clamping mechanisms 92 and 94 consist of a semi-circular receptacle that tubes 45 and 46 fit through. Tightening hardware 98 and 99 clamps the tube or rod to secure them within the receptacle and prevent movement. A single tube or shaft 260 is used to connect with a single drum 11 through a sliding cradle 84.

The sliding cradle 84 connects o the single tube or shaft 260 with dovetail grooves. A second set of dovetail grooves exist on the bridge support member 90. The bridge support member 90 has male dovetail grooves that mate with the female dovetail groves in the tube or shaft 260. A similar set of male dovetail features 85 exist on the sliding cradle 84. These dovetail features are arranged to allow the sliding cradle to slide 86 past the bridge support member 90. The sliding cradle 84 has a recessed cradle 87 for connection with the hinge pins 15 of a single drum 11. The hinge pin 15 is secured to the drum 11 with a rotation hinge plate. The rotation hinge plate 12 and its connection to the drum is shown and described in more detail in FIG. 6 (From May Pat. U.S. Pat. No. 5,691,492). The rotational hinge allows the single drum 11 to be easily placed into the cradle and rotated as in FIG. 5 and FIG. 6.

Figure 6:
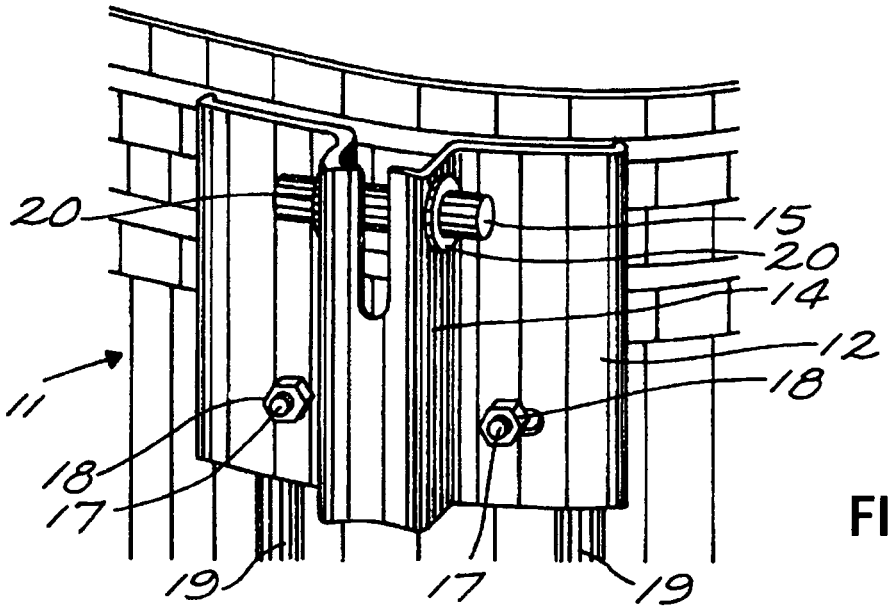
FIG. 6 is a detail view of the stationary hinge of an embodiment of the hardware assembled on a drum with the stationary hinge removed from FIG. 5.

FIG. 6 is a detail view of the rotation hinge of an embodiment of the hardware assembled on a drum with the stationary hinge removed and is referred to as a modified floating snare assembly. The hardware comprises the combination with drum 11 of a supporting hinge assembly having a rotation hinge plate 12 that supports a pair of clamps (not shown) by bolts 17 and nuts 18 for securing rotational hinge plate to drum 111 by clamping on the two drum tension rods 19. Bolts 17 extend through oversized holes or slots which allow for a small amount of lateral adjustment to cover small variances in the spacing of drum tension rods 19 and also in different sized drums, e.g. 13" and 14" drums. Knuckle 14 has aligned holes through which hinge pin 15 extends and washers 20 on opposite ends thereof.

Figure 7:
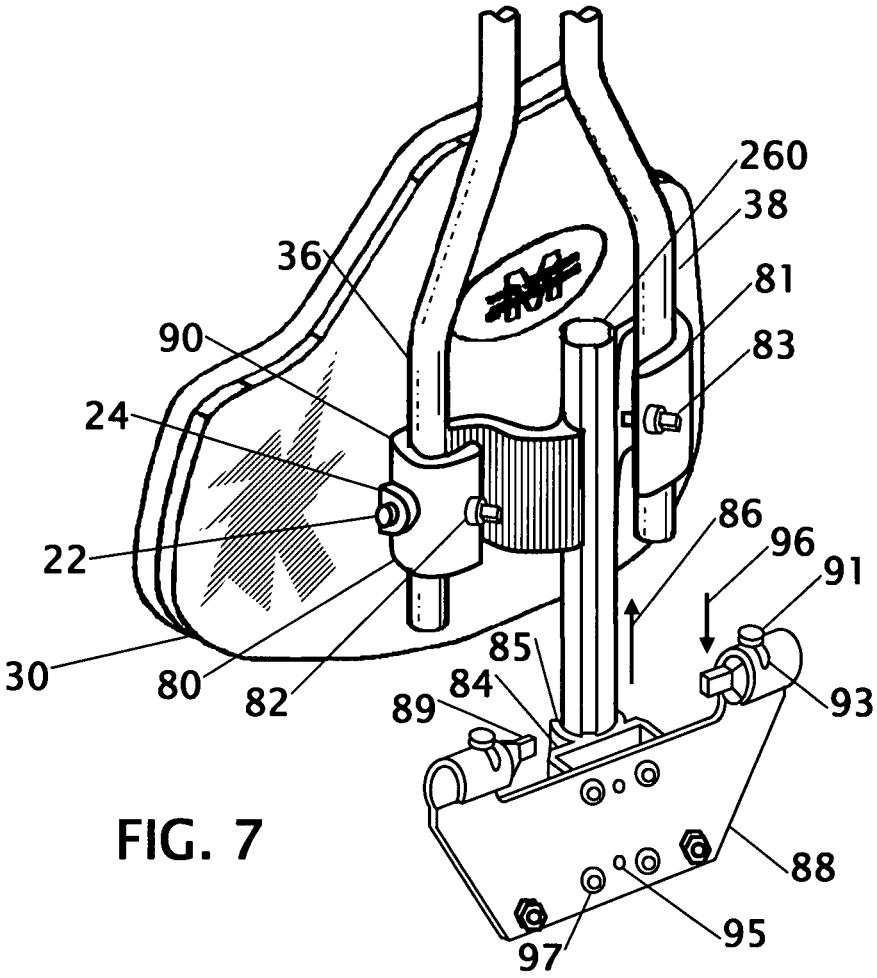
FIG. 7 is an alternate embodiment of the drum tracking system shown in FIG. 5.

FIG. 7 is an alternate embodiment of the drum tracking system shown in FIG. 5. Only the lower portion of the carrier is shown with the drum connecting portion with the independently spread to parallel portions 36 and 38 where they attach to supporting abdomen plate 30. The connection of the abdomen plate is described with FIG. 5. Clamping receptacle(s) 80 and 81 consist of a semi-circular receptacle that tubes 36 and 38 fit through. Tightening hardware 82 and 83 clamps the tube or rod to secure them within the receptacle and prevent movement. A single tube or shaft 260 is used to connect with the single drum mounting hardware through a sliding cradle 84.

The sliding cradle 84 connects o the single tube or shaft 260 with dovetail grooves. A second set of dovetail grooves exist on the bridge support member 90. The bridge support member 90 has male dovetail grooves that mate with the female dovetail groves in the tube or shaft 260. A similar set of male dovetail features 85 exist on the sliding cradle 84. These dovetail features are arranged to allow the sliding cradle to slide 86 past the bridge support member 90.

The sliding cradle 84 is secured to plate 88 with securing blots 97. Movement of the cradle 84 on the single tube or shaft 260 is prevented by locking set screws, or similar hardware, through access hole 95. The securing plate 88 has two drum rotators 89 that where a drum is slid 96 down the elongated tabs 89 gravity holds a drum in the elongated tabs. To rotate a drum thumbscrew 91 is loosened and the drum rotors are turned in the plate 88. The rotation of the drum is limited to the travel of the thumbscrew(s) 91 is slot 93. The structure that connects this hardware to a drum is described in May patent U.S. Pat. No. 5,691,492.

Figure 8:
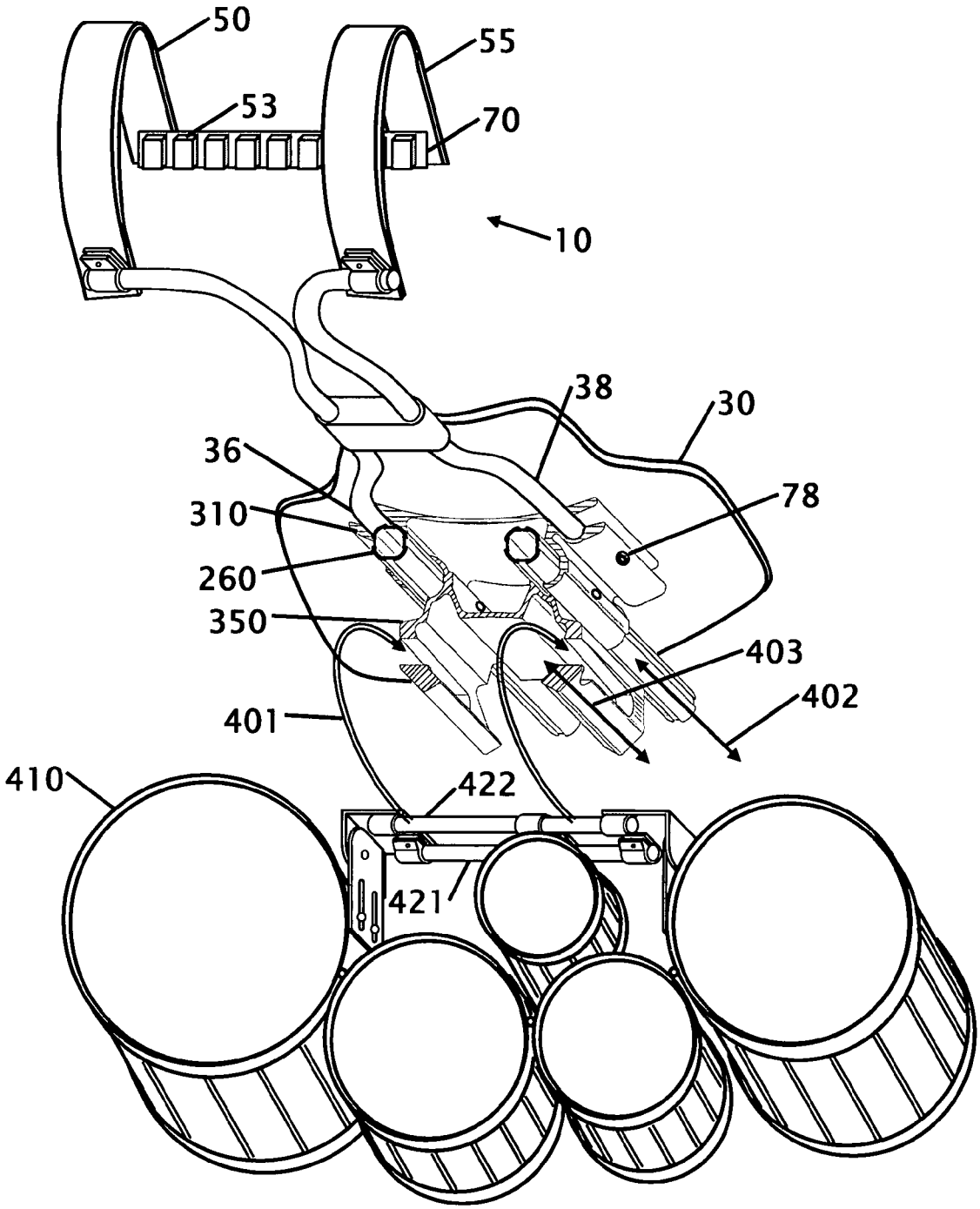
FIG. 8 is a second preferred embodiment showing the dual track system secured to an instrument carrier with a drum assembly that is mountable on the dual track system.

FIG. 8 shows the parallel track system secured to an instrument carrier with a drum assembly that is mountable on the parallel track system. The carrier 10 is similar in construction as was previously described in FIGS. 1 and 5 where the carrier includes shoulder supports or shoulder hooks 50, 55 with an integrated or removable back member 70. The shoulder supports and or back member may optionally include padding 53. The tubular carrier shown includes an abdomen plate 30 that is secured or can float on the structure without being rigidly secured to first bifurcated structure 310. In the embodiment shown the first bifurcated structure 310 is shown and described as a single structure but it is contemplated that the structure could be fabricated in two halves where each half is secured to the abdomen plate to form the structure. Tubes 36 and 38 of the carrier bend and extend into first bifurcated structure 310 where they are positionable and lockable in position using tightening hardware 78. The tubes 260 slide in first bifurcated structure 310 and in second bifurcated structure 350 to allow for positioning of the drum array and drum hardware 410. In the embodiment shown the second bifurcated structure 350 is shown and described as a single structure but it is contemplated that the structure could be fabricated in two halves where each half is secured to the tubes or shafts 260. The tubes or shafts 260 can be movable 402, as well as the second bifurcated structure 350 are movable 403 independently.

Figure 9:
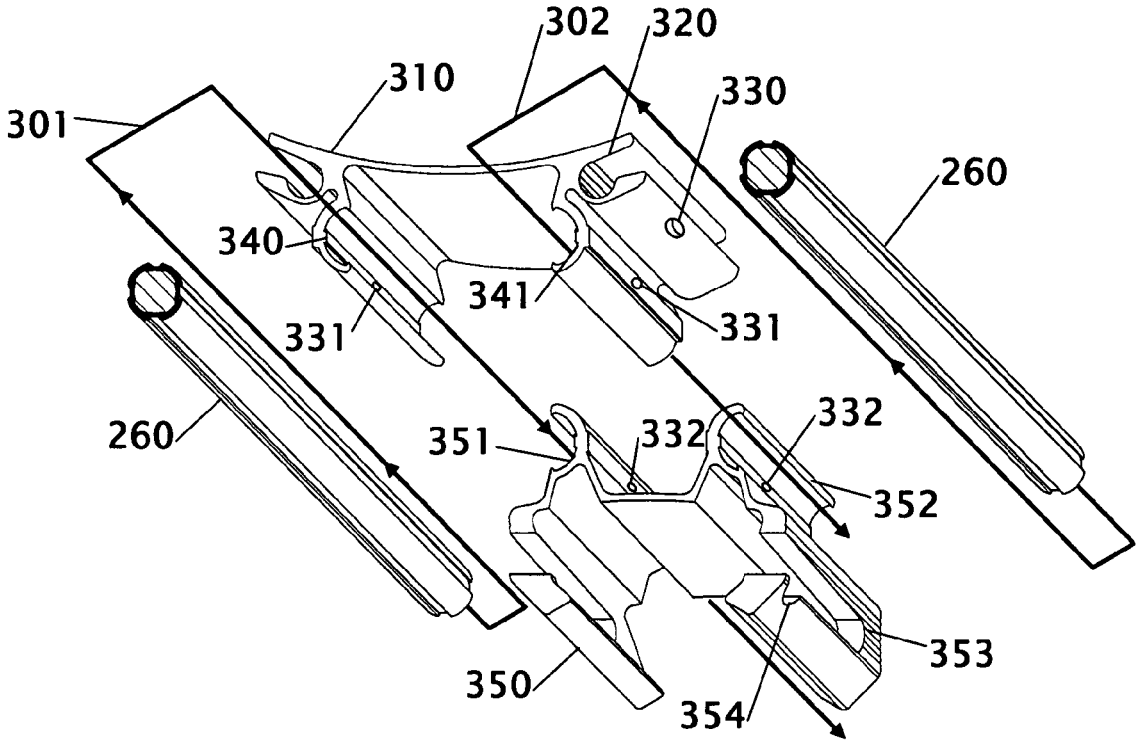
FIG. 9 shows the components of a second preferred embodiment of a dual track system that is mounted to an instrument carrier from FIG. 8.
Figure 10:
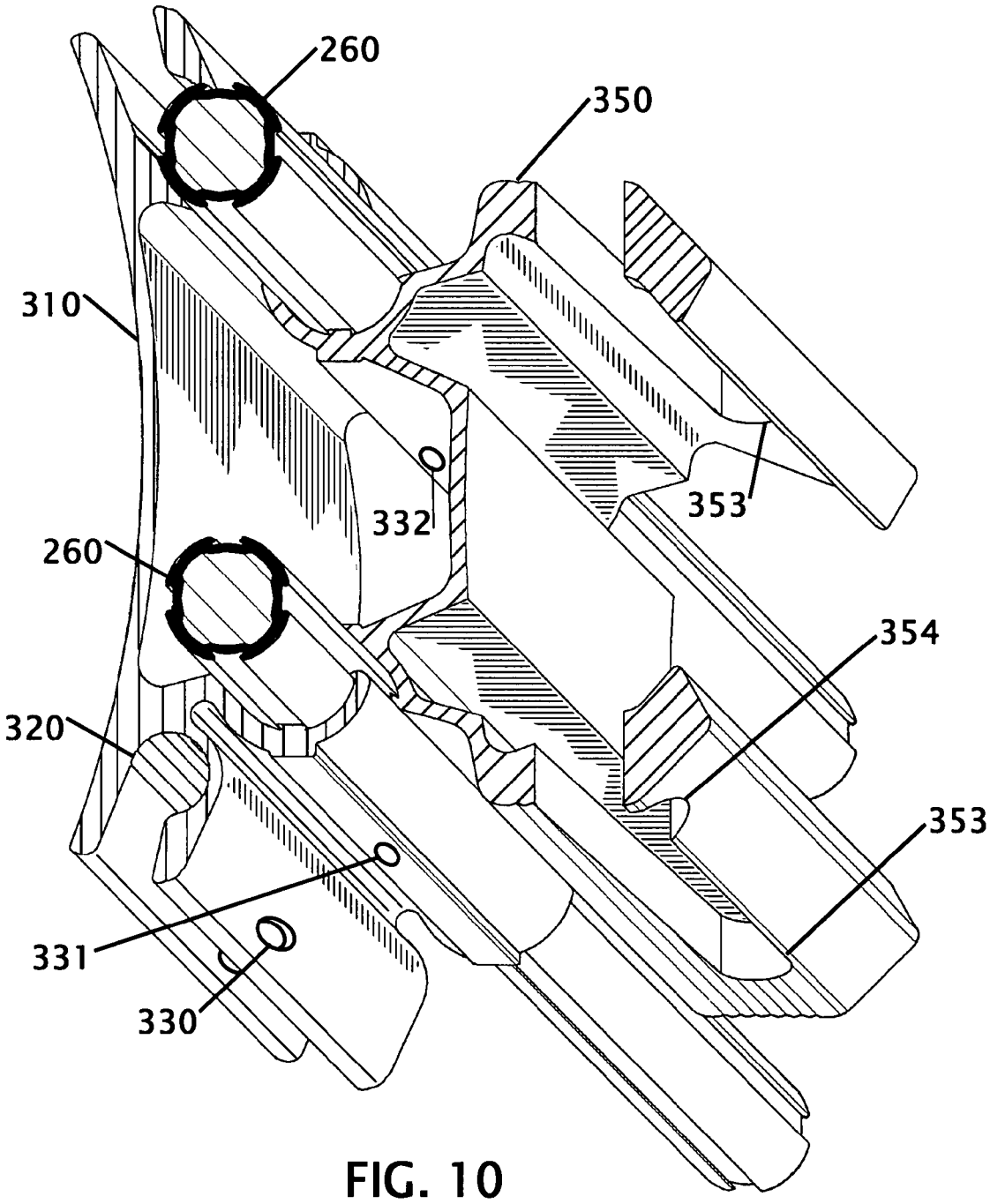
FIG. 10 shows the components from FIG. 9 assembled.

In operation the upper tube 422, from the drum array, is lowered 401 into the essentially vertical slot until the bottom tube 421 from the drum array rests on the bottom radius or saddle (353 from FIG. 9 and FIG. 10). The cantilevered weight of the drum array will rotate the drum array until the upper tube 422 of the drum supporting array sits in the top radius (354 from FIG. 9 and FIG. 10). It is contemplated that the shafts or tubes 260 are fabricatable as an integral part of either first bifurcated structure 310 or the second bifurcated structure 350 to allow for only one adjustment.

FIG. 9 shows the components of a dual track system that is mounted to an instrument carrier. For a better understanding of the components and how they relate, FIG. 9 should be viewed in combination with FIGS. 8 and 10. In FIG. 9 the first bifurcated structure 310 is shown. This first bifurcated structure 310 has a radiused back that matches the contour of the abdomen plate that the structure in mounted on. On the front of first bifurcated structure 310 a pair of linear tracks 340 and 341 are integrated. The parallel tracks provide a first dual track structure. The tracks are located essentially parallel to the abdomen plate and at a location that is distal from the abdomen plate in a vertical orientation. It is contemplated that the abdomen plate 30 can float on the structure without being rigidly secured to first bifurcated structure 310. The first bifurcated structure 310 further includes mounting clamps 320 for securing tubular shafts for connection with the shoulder supporting portion of a carrier. The connection with the tubular portion of the shoulder supported portion of the carrier is shown in FIG. 1. A locking mechanism is threaded or fastened into the carrier at 330 to pinch or thread into the tube(s) 36 or 38 (FIG. 8).

In FIG. 9 tubes 260 are slid 301 and 302 into the linear tracks 340 and 341 respectively. The linear tracks 340 and 341 have male dovetail recesses that engage in female dovetail recesses in tubes or rods 260. The tube and linear track is essentially the same configuration as shown and described in FIGS. 1, 2, 4, and 5. The tubes or shafts 260 are locked in location on the linear tracks of the first bifurcated structure 310 with a securing means such as a set screw 311. The second bifurcated structure 350 engages on the tubes 260 between the first bifurcated structure 310 to allow independent movement of the second bifurcated structure 350. The second bifurcated structure 350 has similar recess 351, 352 and dovetail engagement with the tubes or shafts 260 as in the first bifurcated structure 350. The second bifurcated structure 350 is secured to the tubes or rods 260 with securing means such as a set screw 332. In the front of the second bifurcated structure a pair of essentially vertically oriented slots exists for loading at least one drum or an array of drums (as shown in FIGS. 1 and 5). The vertical slots have a bottom radius or saddle 353 and a top radius 354 for locating the drum or drum array in the essentially vertically oriented slots. A further description of the vertical slots for securing one or more drums is shown and described in more detail with FIGS. 8 and 10.

FIG. 10 shows the components from FIG. 9 assembled. In this assembly the curved surface of first bifurcated structure 310 mounts onto an abdomen plate. The first bifurcated structure 310 further includes optional mounting locations 320 for securing tubular shafts for connection with the shoulder supporting portion of a carrier. A locking mechanism is threaded or fastened into the carrier at 330 to pinch or thread into the tube(s) 36 and 38 (shown in FIG. 8). The tubes or shafts 260 are shown located within first bifurcated structure 310. The tubes or shafts 260 are lockable in location on the linear tracks of component 310 with a securing means located at 331. The second bifurcated structure 350 is shown engaged on the tubes 260 between the first bifurcated structure 310 to allow independent movement of the second bifurcated structure 350. The second bifurcated structure 350 has similar recess and dovetail engagement with the tubes or shafts 260 as the first bifurcated structure. The tubes or shafts 260 are locked in location on the linear tracks of the first bifurcated structure 310 with a securing means located at 331. The second bifurcated structure is secured with set screws or similar hardware 332. The vertical slot for securing drum hardware is shown in this figure with a through bottom radius or saddle 353 to support the lower tube 421 of an array of drums (see FIG. 8) and a top radius 354 for locating and securing the upper tube 422 from the drum array. The upper tube 422 and lower tube 421 can side horizontally in the upper and lower radius or saddle 353, 354 such that the drum array is justified left or right of the player.

Thus, specific embodiments and applications for a carrier with single and dual front mounted linear slides have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A structure for retaining musical instruments on an instrument carrier comprising:

at least one first bifurcated structure mounted on a shoulder supported instrument carrier having a securing track or tracks with at least two parallel linear slider tracks;

said at least two parallel linear slider tracks having integrated structure with said at least one first bifurcated structure;

said at least one first bifurcated structure that maintains said at least two parallel linear slider tracks in a parallel relationship and in an essentially vertical orientation in a normal mode of use;

at least one second bifurcated structure that maintains said parallel relationship of said at least one first bifurcated structure to engage or integrate with said at least two parallel linear slider tracks;

wherein said at least one second bifurcated structure moves with or within said at least two parallel linear slider tracks, and said at least one second bifurcated structure terminates or integrates with a means for mounting a percussion mounting structure for mounting a percussion instrument's playing surface of at least one percussion instrument in an essentially perpendicular relationship to said at least two parallel linear slider tracks.

2. The structure for retaining musical instruments on an instrument carrier as defined in claim 1 wherein the means for mounting a percussion mounting structure allows a drum mounting structure to be moved, positioned or offset horizontally.

3. The structure for retaining musical instruments on an instrument carrier as defined in claim 1 wherein the at least one second bifurcated structure is movable on said at least two parallel linear slider tracks to raise or lower the means for mounting a percussion mounting structure, in relationship to the shoulder supports.

4. The structure for retaining musical instruments on an instrument carrier as defined in claim 1 that further includes an abdomen plate where the vertical load from a drum mounting structure on the means for mounting a percussion mounting structure is not supported by, on or through the abdomen plate.

5. The structure for retaining musical instruments on an instrument carrier as defined in claim 1 wherein a drum mounting structure includes at least one bar, rod, shaft, tube or fluted tube that engages into the means for mounting a percussion mounting structure.

6. The structure for retaining musical instruments on an instrument carrier as defined in claim 1 wherein said drum mounting structure or means for mounting a percussion mounting structure includes at least one indicia to indicate the balanced center or at least one desirable offset location of the drum mounting structure.

7. The structure for retaining musical instruments on an instrument carrier as defined in claim 1 wherein the means for mounting a percussion mounting structure comprises at least one vertical or horizontally oriented slot, groove or recess whereby allowing said at least one percussion instrument to be mounted or dismounted by only manipulation of said percussion instrument in relation to said instrument carrier.

8. The structure for retaining musical instruments on an instrument carrier as defined in claim 1 wherein said at least two parallel linear tracks allows said at least one first bifurcated structure to slide independently or past said at least one second bifurcated structure on said at least two parallel linear slider tracks.

9. The structure for retaining musical instruments on an instrument carrier as defined in claim 1 wherein the at least one first bifurcated structure and or said at least two parallel linear slider tracks structure is constructed as a monolithic unit.

10. The structure for retaining musical instruments on an instrument carrier as defined in claim 1 wherein the location of the abdomen plate on a front carrier portion is adjustable.

11. The structure for retaining musical instruments on an instrument carrier as defined in claim 1 wherein said at least one first bifurcated structure is secured to an abdomen plate.

12. The structure for retaining musical instruments on an instrument carrier as defined in claim 11 wherein the abdomen plate can pivot with free or frictional movement in at least one direction relative to a front carrier portion.

13. The structure for retaining musical instruments on an instrument carrier as defined in claim 1 wherein the abdomen plate is removable from said shoulder supported carrier structure without altering operability of said shoulder supported carrier with a percussion instrument.

14. The structure for retaining musical instruments on an instrument carrier as defined in claim 13 wherein said at least one first bifurcated structure is secured to an abdomen plate.

15. The structure for retaining musical instruments on an instrument carrier as defined in claim 13 wherein the abdomen plate can pivot with free or frictional movement in at least one direction relative to a front carrier portion.

16. The structure for retaining musical instruments on an instrument carrier as defined in claim 1 wherein said at least one first bifurcated structure is separate from an abdomen plate.

17. The structure for retaining musical instruments on an instrument carrier as defined in claim 1 wherein said at least one first bifurcated structure and an abdomen plate form an unified structure.

18. The structure for retaining musical instruments on an instrument carrier as defined in claim 1 wherein said at least two parallel linear slider tracks each include at least one dovetail edge, or at least one elongated slot or at least one elongated tube.

19. The structure for retaining musical instruments on an instrument carrier as defined in claim 1 wherein said at least two linear slider tracks are physically displaced to reduce flexing forces on each individual linear slider track.

20. The structure for retaining musical instruments on an instrument carrier as defined in claim 1 wherein said at least one second bifurcated has guiding surfaces that track on or within said at least two parallel linear slider tracks.

* * * * *